US005177925A

United States Patent [19]

Winkler et al.

[11] Patent Number: 5,177,925

[45] Date of Patent: Jan. 12, 1993

[54] WALL ELEMENT FOR THE DRY CONSTRUCTION OF WALLS

[75] Inventors: Bernhard Winkler, Starnberg, Fed. Rep. of Germany; Alfred Steiner, Andelfingen, Switzerland

[73] Assignee: Waldormills Company Establishment, Vaduz, Liechtenstein

[21] Appl. No.: 619,725

[22] Filed: Nov. 29, 1990

[30] Foreign Application Priority Data

Nov. 30, 1989 [CH] Switzerland ..... 4282/89

[51] Int. Cl.[5] ..... E04B 5/04; E04C 2/04

[52] U.S. Cl. ..... 52/607; 52/608; 405/284; 405/286; D25/114

[58] Field of Search ..... 52/604, 605, 606, 607, 52/608, 609, DIG. 2; 405/284, 286; D25/114, 118, 115; 47/83

[56] References Cited

U.S. PATENT DOCUMENTS

| | | | |
|---|---|---|---|
| 3,418,774 | 12/1968 | Kocher et al. | 52/608 |
| 4,016,693 | 4/1977 | Warren | 52/605 X |
| 4,379,659 | 4/1983 | Steiner | 52/608 X |
| 4,380,887 | 4/1983 | Lee | 52/606 X |
| 4,521,138 | 6/1985 | Steiner | 52/608 X |
| 4,532,748 | 8/1985 | Rotherham | 52/605 |
| 4,802,320 | 2/1989 | Forsberg | 52/608 X |
| 5,072,566 | 12/1991 | Zeidman | 52/608 |

FOREIGN PATENT DOCUMENTS

| | | | |
|---|---|---|---|
| 0013535 | 7/1979 | European Pat. Off. | 52/604 |
| 2537408 | 4/1976 | Fed. Rep. of Germany | 52/608 |
| 2924310 | 6/1978 | Fed. Rep. of Germany | 405/286 |

*Primary Examiner*—David A. Scherbel
*Assistant Examiner*—Kien Nguyen
*Attorney, Agent, or Firm*—Lewis H. Eslinger; Jay H. Maioli

[57] ABSTRACT

A wall element consists of a ground wall with a shield that is placed on it perpendicularly and side walls extending laterally from the shield to the rear. In high walls that can be 7 meters or higher, in order to withstand the high static load that exerts force on the ground wall the side walls are formed in such a manner that their upper front surfaces are situated above the groove-shaped recesses located in the bottom surface of the ground wall, so that the load is transferred only via the side walls and prevents the side walls from collapsing.

6 Claims, 4 Drawing Sheets

WALL ELEMENT FOR THE DRY CONSTRUCTION OF WALLS

BACKGROUND OF THE INVENTION

1. Field of the Invention

This invention relates generally to a wall element for the dry construction of walls and, more particularly, to a construction kit used to fortify embankment, as well as to an embarkment wall that is formed with the help of the construction kit.

2. Description of the Background

Elements of this type are generally known in the construction of landscaping, as well as for supporting steep embankments. Probably the oldest form of a trough-shaped element consisting of a front wall, a ground wall, and two side walls is described in U.S. Pat. No. 1,542,909. This element is intended as a brick to be filled with mortar, whose trough is situated in the direction of the longitudinal extension of the wall.

A similar element is described in Swiss Patent CH-A-587 390, however, it is intended for layering and to this end exhibits two groove-shaped recesses that are arranged perpendicular to the shield and come to lie over the side walls of the elements located below when the elements are layered in staggered form. This provides a retaining wall with an extraordinary degree of stability, because the elements cannot be displaced sideways. In order to make it at least more difficult for a forward displacement to occur, the shield is formed to be higher than the side walls, so that upper elements arranged with gaps are situated behind the shields of the two element located beneath them which presses them downward as a result of the weight. The troughs are filled with soil or humus and can be planted. On the one hand, this makes it possible to provide the concrete wall with greenery and, on the other hand, allows the plants to root in the natural soil located to the rear of the wall.

A variant of this element is described in European Patent Ep-A- 0 047 718. Both the shield and the wings project over the side walls on both sides. A transverse wall in the trough divides same into a front pan that is closed and into a rear trough that is open to the rear. In connection with other elements, both the broadened shields and the extending wings result in additional chambers which together with the pans located in the front, form wave traps in the case of waterways or lakes in the area of the respective water level. This makes it possible to plant the troughs located in the rear, because the pan make it somewhat more difficult for the soil to be washed out of the troughs.

Experience has shown that in the case of a higher construction, that is, in excess of approximately 7 meters, the elements according to the above-mentioned Swiss patent CH-A- 587 390 can collapse, especially when the trough is filled with a compressible material, such as humus, for example. Inspections undertaken on broken elements have shown that the support at the ground in the recesses causes a moment on the side walls, making it possible to break off the side wall.

Hence, it is an object of this invention to eliminate these disadvantages in all embodiments of such elements.

DETAILED DESCRIPTION OF PREFERRED EMBODIMENTS

Figure 1:
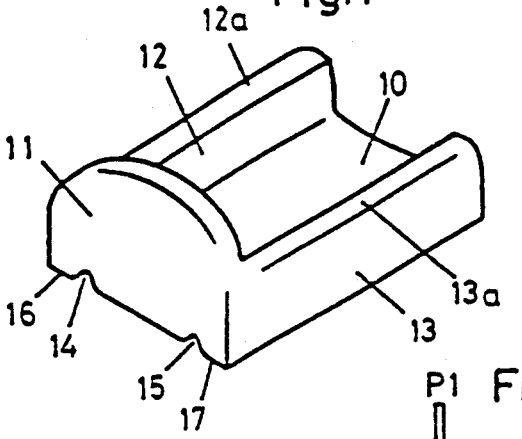
FIG. 1 is a perspective view of a wall element similar to Swiss Patent CH-A- 587 390 in a form that is modified according to the invention.

The brick according to FIG. 1 shows the generally known embodiment having ground wall 10, a shield 11 arranged on it to be perpendicular, and side walls 12, 13 that are arranged on both sides of the ground wall 10. As is visible at the bottom of the parallel, gutter-shaped recesses 14, 15. At the top and on its sides the shield is rounded, moreover, all front surfaces can be rounded in order to create similarity to a natural stone. The shield 11 can be aligned with the side walls according to Swiss Patent CH-A- 587 390 or can project over the side walls according to European Patent EP-A- 0 047 718.

Figure 3:
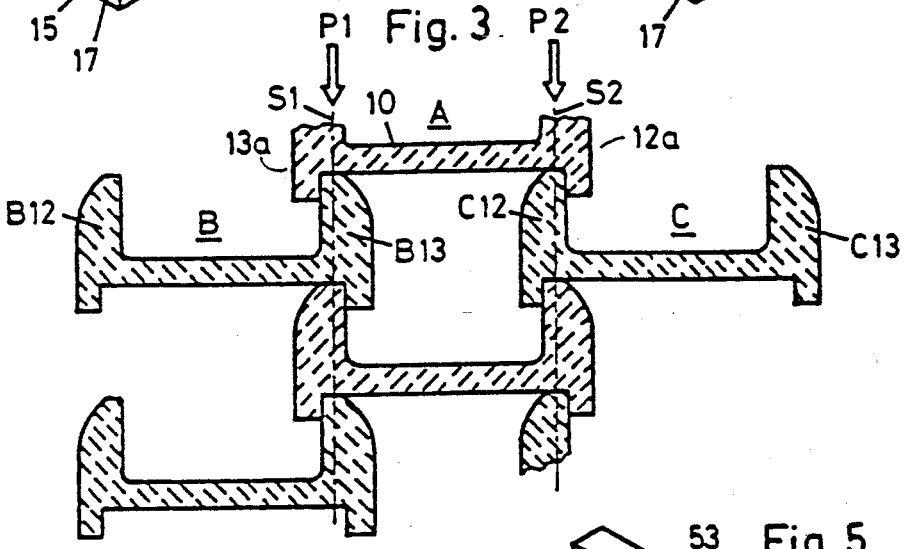
FIG. 3 is a cross-section of a dry-constructed wall having elements pursuant to FIG. 2, whereby the cutting plane is situated behind the shields of the two elements.

As is shown in FIG. 3, the side walls 12, 13 can be designed to be thicker than in the known embankment brick according to Swiss Patent CH-A- 587 390; specifically, the upper front surface 12*a*, 13*a* is flat and is located perpendicularly above the gutter-shaped recesses 14, 15 in such a manner that in the case of elements layered in composite form, the ground wall 10 of an element A is supported beneath its side walls 12*a*, 13*a* with side walls B12 and C13 by elements B and C located below. As is clearly indicated by the dash-dot lines S1 and S2, according to the arrows P1 and P2, the forces are always exerted on the side walls 12, 13, thus preventing the loads from bearing on the points of contact to preclude the resulting destruction of the elements.

As is shown in FIGS. 1 and 3, instead of having groove-shaped recesses 14, 15, the underside of the ground wall could be designed with two lateral support ledges 16, 17 projecting into the shield 11. The shield 11, in turn, could also be extended downward, so that the wide recess 18 between the support ledges 16, 17 remains invisible from the front.

Figure 2:
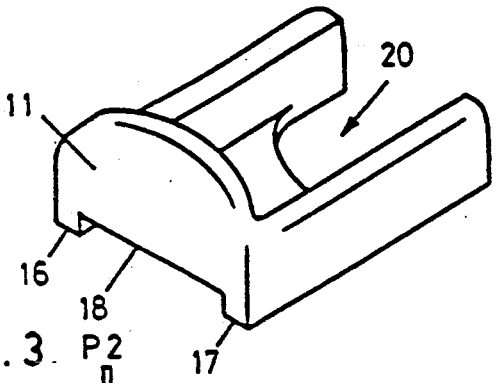
FIG. 2 is a perspective view of a second embodiment of the invention.
Figure 4:
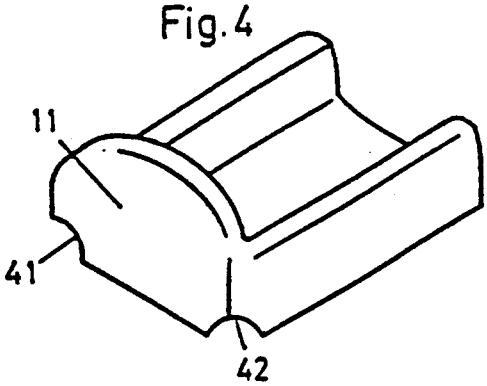
FIG. 4 is a perspective view of a third embodiment of the invention.

The shield 11, which projects in width or in height or both makes it possible that elements layered in composite form according to FIG. 1 or 2, crop out or extend together with parts in front of the side walls 12, 13, at the rear of the shield 11, thus receiving support that prevents them from sliding forward. This provides the layered wall with an angle of inclination that is determined by the thickness of the shield 11. It is often desirable, however, to form a wall that appears to be perpendicular. In the case of wall elements of the type previously described according to FIGS. 2 or 3, this can be achieved according to FIG. 4 by providing the shield 11 on both sides at its lower lateral parts with clearances 41, 42 whose boundary lines have the same shape as the upper lateral parts of the shield 11. This makes it possible to layer the elements in perpendicular fashion adjacent to and above one another in such a manner that the elements protrude into these clearances 41, 42 with their adjoining shields, thus making it unnecessary to offset by the thickness of the shield and allowing perpendicular construction of the wall. This eliminates the security provided by the support behind the shields, and the bricks remain in place only as a result of the friction, which suffices in many cases.

Figure 5:
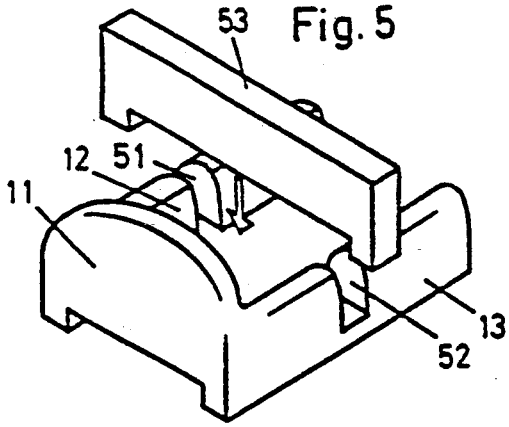
FIGS. 5 and 6 are perspective views of an element according to FIGS. 1 or 2 to be used for building obstacles on river embankments in the area of the water level.
Figure 6:
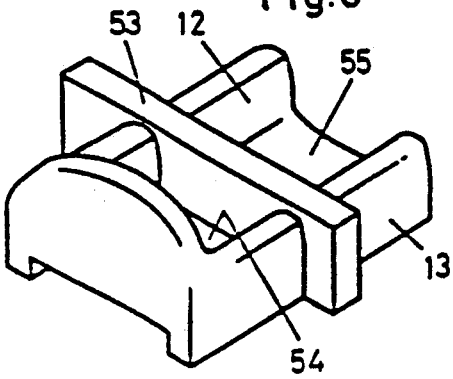

Instead of the extensive manufacturing process required for elements according to the previously mentioned European Patent EP-A- 0 047 718, whereby the trough is divided into two chambers, by providing the thickened side walls 12, 13 according to FIG. 5, a slot-shaped clearance 51, 52 in the two side walls 12, 13 can be arranged at equal distances behind shield 11. According to FIG. 6, a separating wall 53 in the shape of a plate can also be used to create an element intended for constructing obstacles at river embankments that is equipped With a front wave trap 54 and trough 55 that is open to the rear.

Specifically, in light of the design of the side walls 12, 13 according to the invention, the elements can be equipped with such slot-shaped clearances 51, 52 in all applications, because the particularly advantageous arrangement of the layers according to FIG. 3 does not at any point result in a possibly destructive exertion of force, as occurred in earlier embodiments.

Figure 8:
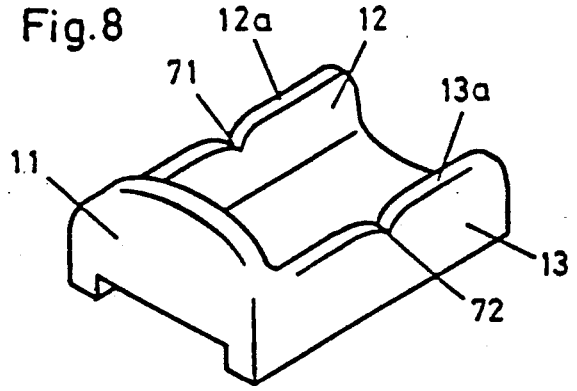
FIG. 8 is a perspective view of a fifth embodiment of the invention.
Figure 9:
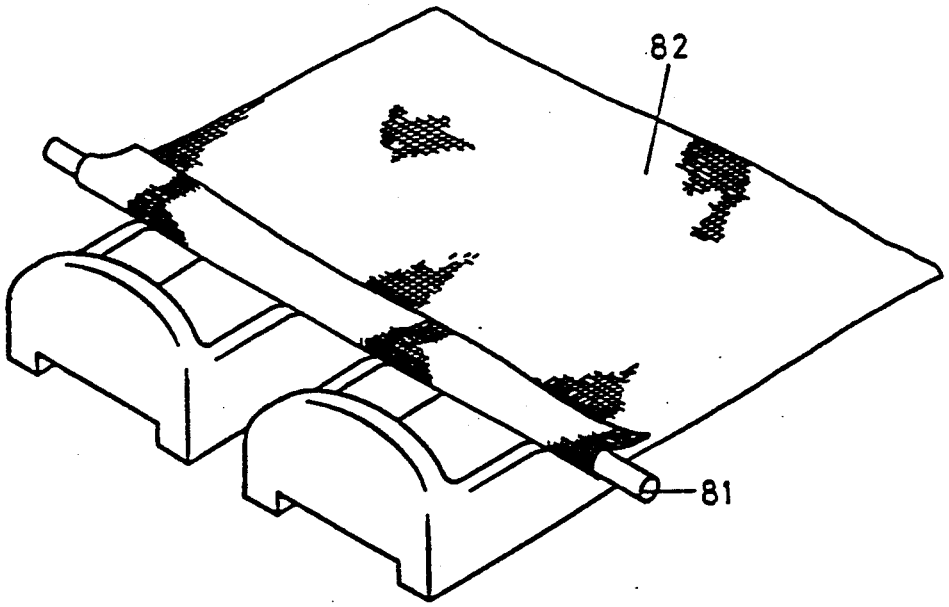
FIG. 9 shows a perspective view of two adjacent elements according to FIG. 8 having a textile fabric used to anchor the wall elements.

Instead of the slot-shaped clearances 51, 52, the upper front surfaces 12*a*, 13*a* of the side walls 12, 13, could be equipped with notches 71, 72 at equal distances behind shield 11 (FIG. 8). According to FIG. 9, reinforcing iron 81 for concrete or the like, that is enclosed in a woven fabric is placed inside these notches and its free end is inserted into the soil located all the way in the rear in order to provide the wall with a high degree of stability.

Figure 10:
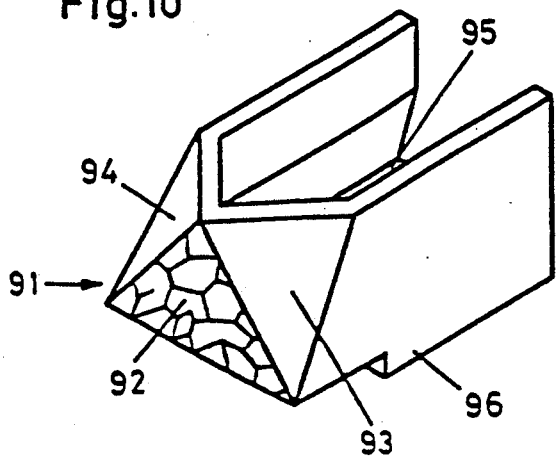
FIG. 10 is a perspective view of a wall element having a modified shield.

Finally, FIG. 10 shows yet another variant of the rounded shield 11 presented in the previously mentioned embodiments. This shield consists of three triangular surfaces 92, 93, 94, of which the front surface 92 is arranged perpendicular to the ground wall 95, thus representing an isosceles or an equilateral triangle. The two additional triangular surfaces 93, 94 are also isosceles or equilateral triangles whose base lines, in contrast to the first-mentioned triangle 92, are now located at the top, thus forming the upper boundary. Here, too, of course, provision is made to ensure that the side walls exhibit a certain form, so that in the case of composite layering the load resulting from elements located above one another is exerted only via the side walls of the elements located below. In order to obtain a perpendicular arrangement of the frontal, center triangles 92 when the lateral triangles 93, 94 are pulled far to the rear, the supporting ledges 96 may extend forward only to such a degree that they can engage in the trough behind the lateral triangles 93, 94.

As is shown in FIG. 2, the ground wall 10 can have a clearance 20 in the rear. This clearance, however, could also be arranged in the center, so that the rear edge appears to be bounded by a transverse bridge. Such a clearance makes it possible specifically to decrease further the greater weight of the elements resulting from the greater thickness of the side walls.

Figure 7:
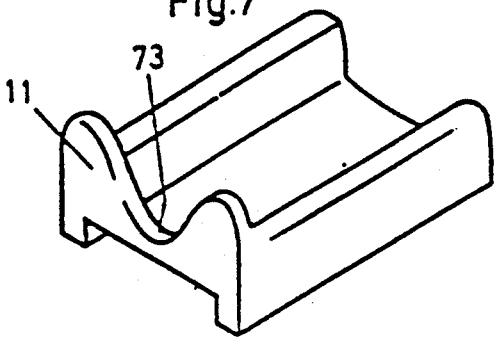
FIG. 7 is a perspective view of a fourth embodiment of the invention.

Often, surface water from rain or wet surroundings must be collected and drained. With the help of a recess 73 arranged in the center of shield 11 (FIG. 7), these wall elements can be combined to form a channel, which, in turn, forms a channel extending along the entire length of the wall, for example, when the element wall is inclined.

Figure 11:
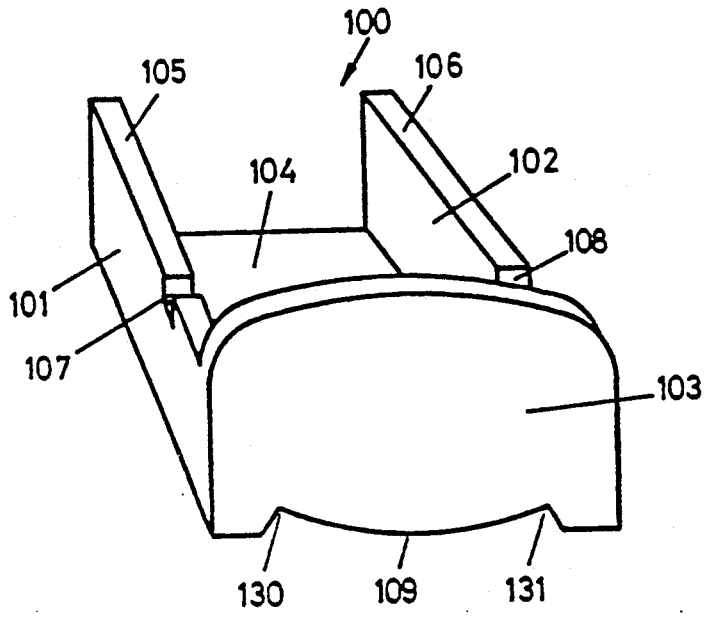
FIG. 11 is a perspective representation of an embankment brick in a sixth embodiment of the invention.
Figure 12:
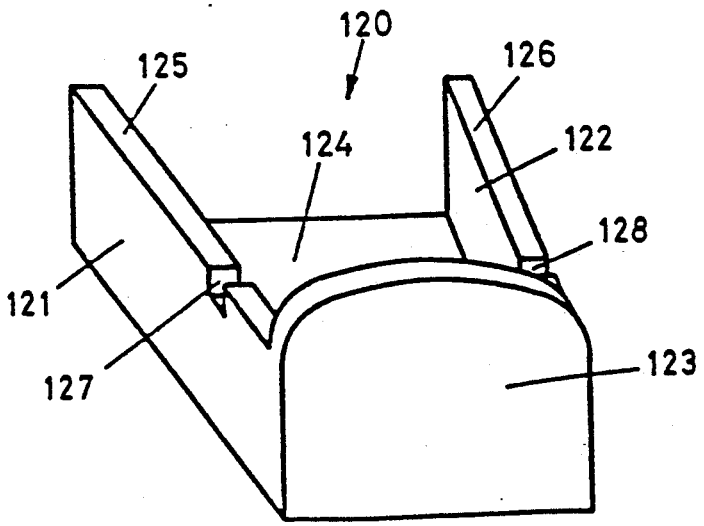
FIG. 12 is a perspective representation of an embankment brick in a seventh embodiment of the invention.

The two embankment bricks according to FIG. 11 and 12 each have a ground wall 104, 124 which, in turn, can also be equipped with partial clearances 107, 108 and 127, 128, two side walls 102, 102, 121, 122, as well as a shield 103, 123. At the end where the shield is located, the distance between the side walls 101, 102 in FIG. 11 is greater than the distance at the free end and, in contrast, the distance between the side walls 121, 122 in FIG. 12 is narrower at the end where the shield is located. Hence, the two embankment bricks according to FIGS. 11 and 12 differ from one another only insofar as the shield 103, 123 could be arranged at one of the two ends. In each case, the troughs 104, 124 conform to one another and exhibit side walls 101, 102, or 121, 122, respectively, whose distance relative to one another broadens. The shields 103, 123 are arched upward in convex form, and the front edges can be rounded.

This arrangement results in the formation of a trough that is open at the top and in the rear. The shield 103, 123 projects over the respective side walls 101, 102, and 121, 122, respectively, at least in height, but they could also project over same in width. In each instance, at the time the wall is built, this creates support for the respective upper stone, thus, preventing it from sliding forward. In the rear area of the ground wall 104, 124, provision can be made for a traverse rib extending upward in order to form a pan-shaped recess above the ground wall. Such transverse ribs are not represented in FIGS. 11 and 12, because such a raised part is easily imagined.

It is the purpose of the recess thus formed to retain water so that the soil does not dry out even when the shield is subjected to lots of sun. Hence, the plants used to provide the wall with greenery receive the humidity the require until their roots have grown into the soil located behind the wall.

A brick having a trough that tapers toward the rear, as is shown in FIG. 11, provides additional support with the help of the root ball of the plant. The rib can fulfill a similar purpose in the brick according to FIG. 12, whereby the composite construction of a wall a narrowing is also formed in this manner in the rear part of the brick.

Clearances 107, 108, 127, 128 located opposite one another are arranged on the upper front surfaces 105, 106, 125, 126 of the side walls 101, 102, 121, 122. At the time the wall is built, reinforcing iron for concrete or concrete beams can be placed inside these clearances in order to connect the stones sideways or to secure woven meshes according to FIG. 10. On the other hand, the shield 103, provided it is equipped at its bottom with a lobe 109 that projects under the ground wall 104, can engage in these clearances, thus forming a tooth-shaped linkage.

As is indicated in FIG. 11, the ground wall 104 can exhibit two recesses 130, 131 in its bottom surface. These recesses 130, 131 can be arranged parallel to the side walls 101, 102; however, they can also form another angle relative to the front surface of the shield, namely to make it possible for the side walls 101, 102 to engage in the recesses when the bricks are layered, thus forming a lateral tooth-shaped linkage. The grooves can also be crossed or arranged in pairs in the shape of a V in order to permit an engagement when stones of the same kind are used according to FIG. 15 and when dissimilar stones are arranged according to FIG. 16.

Figure 13:
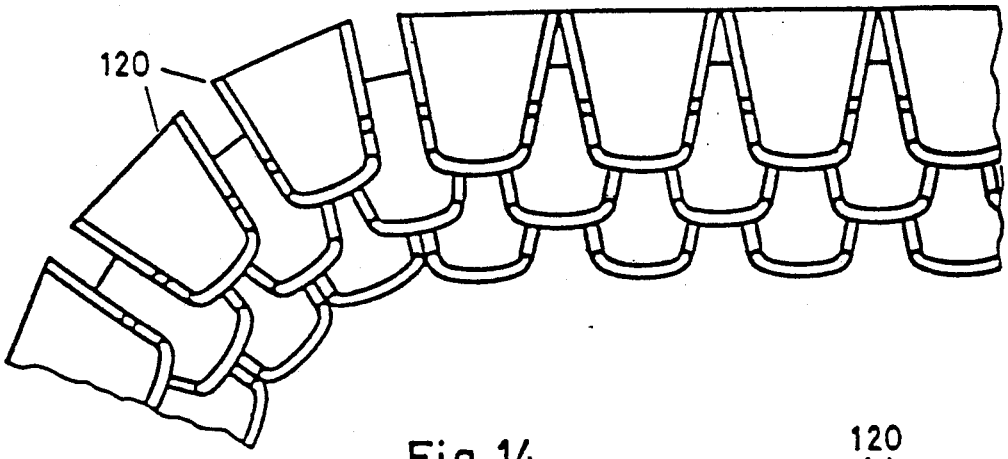
FIG. 13 is a ground plan of an embankment wall with embankment bricks pursuant to the embodiment of FIG. 12.
Figure 14:
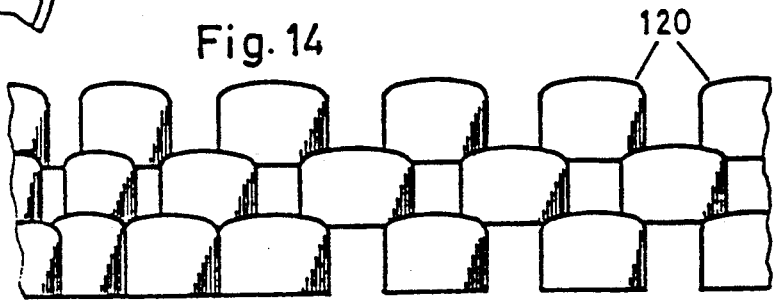
FIG. 14 is an elevational view of an embankment wall according to FIG. 13.

FIGS. 13 and 14 each show a wall that is constructed using embankment bricks according to FIG. 12. Such stones can be used to build straight, as well as concave, walls.

Figure 15:
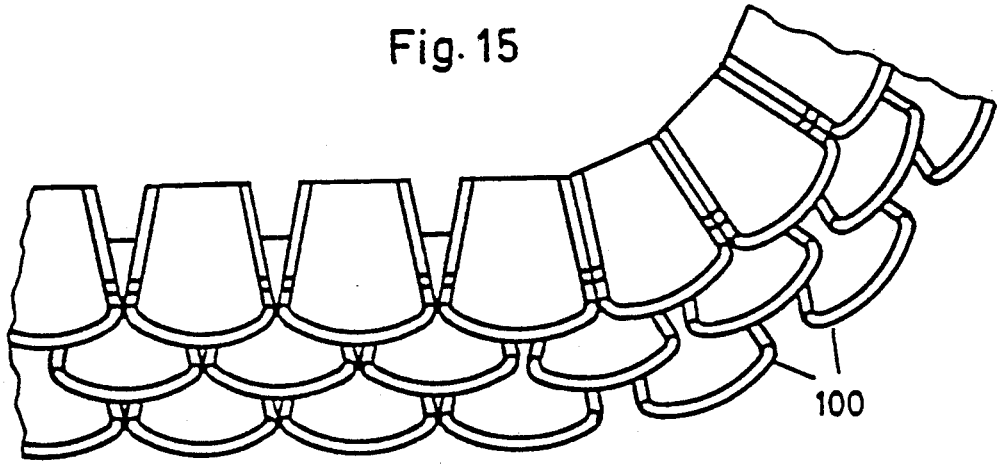
FIG. 15 is a ground plan of an embankment wall with embankment bricks pursuant to the embodiment according to FIG. 11.

The situation is different with the embankment bricks according to FIG. 11 which also permit the construction of straight walls according to FIG. 15 but are better suited for building walls having a convex curvature.

Figure 16:
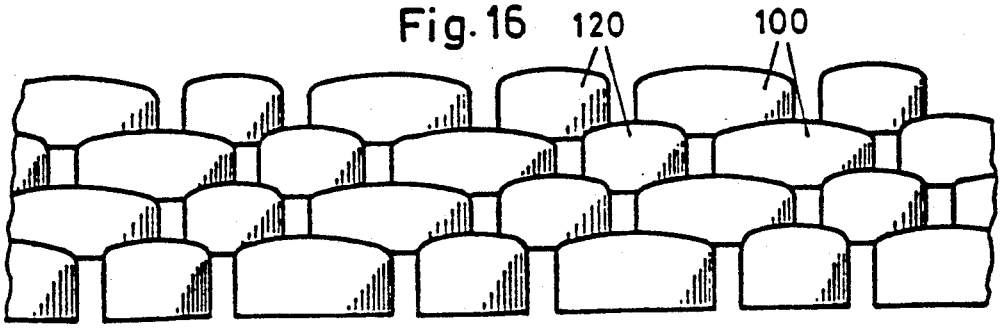
FIG. 16 is an elevational view of an embankment wall with embankment bricks, combining the sixth and seventh embodiments.

The front view according to FIG. 16 shows a wall, which can be advantageously built with the help of both types of embankment bricks according to both FIG. 11 and FIG. 12. Although even in this case the result is an emphasis on the horizontal lines, at least the regularity in the vertical is eliminated. Thus, the wall receives a visible surface reminding the observer more of a natural stone wall than, for example, walls according to FIGS. 13 through 15.

Undoubtedly, surface striations in the shield 103, 123 can result in a strongly modified appearance. Although shields 103, 123 are represented with flat front walls in FIGS. 11, 12, they can, of course, also be curved, as is shown in FIGS. 13 through 16, where the shields are represented in curved fashion and merge seamlessly into the sidewalls.

Having described preferred embodiments with reference to the accompanying drawings, it is to be understood that the invention is not limited to those precise embodiments and that various changes and modifications could be effected by one skilled in the art without departing from the spirit or scope of the novel concepts of the invention, as defined in the appended claims.

What is claimed is:

1. A concrete, trough-shaped, wall element for the dry construction of walls comprising: a front shield, two side walls extending to the rear, and a ground wall located beneath the front shield and two side walls, wherein the ground wall on its underside includes at least one recess arranged parallel to the side walls, wherein each side wall is narrower on its free upper front surface than at its base part, and wherein a slot having parallel walls is provided in each side wall extending through the entire width of each side wall, and wherein an insertion plate is inserted in said slot to subdivide the trough-shaped, wall element into a front pan and rear trough, the insertion plate having a width for insertion into said slots, a breadth exceeding a total breadth of the element and extending beyond outer surfaces of each side wall, a height substantially equal to a height of the element, and a bottom recess for enabling the insertion plate to engage lower portions of the outer surfaces of each side wall.

2. An element according to claim 1, wherein the at least one recess is arranged from an edge perpendicular to and at the bottom surface of the ground wall, and wherein the ground wall includes on outer surfaces thereof respective lateral support ledges located beneath the side walls and extending over at least part of the length of the trough-shaped wall element.

3. An element according to claim 1, wherein the shield projects over the side walls in both width and height.

4. An element according to claim 3, wherein the shield is formed as a rounded plate.

5. An element according to claim 1, wherein all front surfaces on the side walls are rounded.

6. An element according to claim 1, wherein all front surfaces of the shield are rounded.

* * * * *